US006835466B2

(12) United States Patent
Fujimoto et al.

(10) Patent No.: US 6,835,466 B2
(45) Date of Patent: Dec. 28, 2004

(54) ALLOYED GALVANIZED STEEL PLATE HAVING EXCELLENT SLIDABILITY

(75) Inventors: Kyoko Fujimoto, Chiba (JP); Makoto Shimura, Chiba (JP); Yoichi Tobiyama, Chiba (JP); Susumu Satoh, Chiba (JP)

(73) Assignee: JFE Steel Corporation, Tokyo (JP)

( * ) Notice: Subject to any disclaimer, the term of this patent is extended or adjusted under 35 U.S.C. 154(b) by 188 days.

(21) Appl. No.: 10/311,236

(22) PCT Filed: Dec. 5, 2001

(86) PCT No.: PCT/JP01/10612

§ 371 (c)(1),
(2), (4) Date: Dec. 17, 2002

(87) PCT Pub. No.: WO02/097151

PCT Pub. Date: Dec. 5, 2002

(65) Prior Publication Data

US 2003/0175549 A1 Sep. 18, 2003

(30) Foreign Application Priority Data

May 28, 2001 (JP) ..... 2001-158364
Sep. 14, 2001 (JP) ..... 2001-279774

(51) Int. Cl.[7] ..... B32B 15/00

(52) U.S. Cl. ..... 428/659; 205/155; 428/908.8; 428/935

(58) Field of Search ..... 428/659, 908.8, 428/935; 205/155

(56) References Cited

U.S. PATENT DOCUMENTS 6,465,114 B1 * 10/2002 Honda et al. ..... 428/659

FOREIGN PATENT DOCUMENTS

JP 2000-192209 7/2000

* cited by examiner

*Primary Examiner*—Robert R. Koehler
(74) *Attorney, Agent, or Firm*—Young & Thompson

(57) ABSTRACT

An alloyed hot-dip galvanized steel sheet is obtained by forming a hot-dip galvanized layer on the surface of the steel sheet and then alloying the steel sheet. The steel sheet exhibits a potential of −850 mV or less when it is immersed in a zinc sulfate-sodium chloride electrolyte. Alternatively, when it is electrolyzed according to constant potential electrolysis process in a zinc sulfate-sodium chloride electrolyte at a potential in a range from −940 mV to −920 mV, the quantity of electricity consumed is less than or equal to 0.5 C/cm$^2$. The steel sheet exhibits excellent processability and particularly excellent sliding property.

2 Claims, 1 Drawing Sheet

ALLOYED GALVANIZED STEEL PLATE HAVING EXCELLENT SLIDABILITY

TECHNICAL FIELD

The present invention relates to an alloyed hot-dip galvanized steel sheet with excellent sliding property which is suitable as an anti-corrosive steel sheet for use in car bodies.

BACKGROUND ART

Alloyed hot-dip galvanized steel sheets are widely used as anti-corrosive steel sheets for use in car bodies. The alloyed hot-dip galvanized steel sheets are molded into car bodies by pressing and must therefore be excellent not only in anti-corrosive properties but also in sliding properties.

Process steps for manufacturing an alloyed hot-dip galvanized steel sheet are broadly divided into the process step of immersing a material steel sheet in a plating bath to form a hot-dip galvanized layer on the surface of the steel sheet, and the step of subjecting the steel sheet carrying the hot-dip galvanized layer to alloying to thereby form an alloyed hot-dip galvanized layer.

The hot-dip galvanized layer formed on the surface of the steel sheet in the plating bath comprises an intermetallic compound of Zn and Fe (ζ, δ1, Γ), and the sliding property of the alloyed hot-dip galvanized layer formed by alloying varies depending on the composition of the intermetallic compound. Various techniques have therefore been proposed in which the sliding property of an alloyed hot-dip galvanized steel sheet is improved by controlling the composition of such an intermetallic compound of the hot-dip galvanized layer formed prior to alloying.

For example, Japanese Unexamined Patent Application Publication No. 9-209106 discloses a steel sheet for use in alloyed hot-dip galvanized and an alloyed hot-dip galvanized steel sheet. This technique intends to form an alloyed hot-dip galvanized layer with satisfactory sliding property by controlling the composition of the base steel sheet. However, the composition of the hot-dip galvanized layer varies with changes in operating conditions of the plating process step and affects the sliding property of the resulting alloyed hot-dip galvanized layer. Accordingly, the technique disclosed in Japanese Unexamined Patent Application Publication No. 9-209106 cannot significantly yield satisfactory sliding property stably.

Japanese Unexamined Patent Application Publication No. 11-200004 discloses an alloyed hot-dip galvanized steel sheet with excellent sliding property. This technique intends to manufacture an alloyed hot-dip galvanized steel sheet with high sliding property and resistance to plating adhesion failure by depositing a crystal mainly containing Ti and Al on the surface of the alloyed hot-dip galvanized layer. To deposit a crystal mainly containing Ti and Al, a plating bath must comprise Ti. However, when the plating bath comprises Ti, a Ti—Al intermetallic compound (so-called "dross") is formed and adheres to the hot-dip galvanized layer to cause problems in the surface appearance of the resulting galvanized steel sheet.

DISCLOSURE OF INVENTION

Accordingly, an object of the present invention is to solve the above problems and to provide an alloyed hot-dip galvanized steel sheet stably exhibiting excellent sliding property.

The present inventors have made detailed investigations on alloyed hot-dip galvanized layers with excellent sliding property.

Specifically, the present inventors have made investigations on-electrolytic behavior of alloyed hot-dip galvanized layers by electrolyzing them according to a constant potential electrolysis using various alloyed hot-dip galvanized steel sheets as an anode and an aqueous zinc sulfate-sodium chloride solution as an electrolyte. Furthermore, the present inventors have made investigations on the relationship between the quantity of electricity required by the constant potential electrolysis and the sliding property. As a result, they have found that alloyed hot-dip galvanized steel sheets exhibiting a potential of less than or equal to a specific level, when they are immersed in the electrolyte, have satisfactory sliding property and that alloyed hot-dip galvanized steel sheets, in which the total quantity of electricity consumed until the completion of electrolysis is less than or equal to a specific level, have satisfactory sliding property.

The present invention has been accomplished based on these findings and further investigations.

Specifically, the invention provides an alloyed hot-dip galvanized steel sheet with excellent processability and particularly with excellent sliding property, exhibiting a potential to a saturated calomel electrode of less than or equal to −850 mV when it is immersed in a zinc sulfate-sodium chloride electrolyte. The invention also provides an alloyed hot-dip galvanized steel sheet with excellent processability and particularly with excellent sliding property in which, when the alloyed hot-dip galvanized steel sheet is electrolyzed according to a constant potential electrolysis process in a zinc sulfate-sodium chloride electrolyte at a potential to a saturated calomel electrode of from −940 mV to −920 mV, the quantity of electricity consumed is less than or equal to 0.5 $C/cm^2$.

When the quantity of the electricity is less than or equal to 0.3 $C/cm^2$, the resulting alloyed hot-dip galvanized steel sheet exhibits preferable sliding property.

BEST MODE FOR CARRYING OUT THE INVENTION

The alloyed hot-dip galvanized steel sheet of the present invention satisfies the following requirement. When the alloyed hot-dip galvanized steel sheet is electrolyzed according to the constant potential electrolysis process in a zinc sulfate-sodium chloride electrolyte at a potential to a saturated calomel electrode in a range of from −940 mV to −920 mV, the quantity of electricity consumed is less than or equal to 0.5 $C/cm^2$. Alternatively, when the alloyed hot-dip galvanized steel sheet is immersed in the electrolyte, it exhibits a potential to a saturated calomel electrode of less than or equal to −850 mV. Base steel sheets having some textures or surface dimensions do not always satisfy the both requirements, but the objects can be achieved only if either of the two requirements is satisfied.

When the quantity of electricity consumed during constant potential electrolysis is less than or equal to 0.5 $C/cm^2$, the alloyed hot-dip galvanized steel sheet exhibits satisfactory properties in various tests for determining sliding property. The end point of constant potential electrolysis is set at the time when an electrolysis current density decreases and reaches 5 $\mu A/cm^2$. An example of such tests for determining sliding property is a cylindrical flat-bottom cup drawing test. The constant potential electrolysis is performed in a zinc sulfate-sodium chloride electrolytic solution using an alloyed hot-dip galvanized steel sheet as an anode at a potential to a saturated calomel electrode in a range of from −940 mV to −920 mV. To electrolyze portions of the alloyed hot-dip galvanized layer which significantly affect the sliding property selectively, the potential is set at −940 mV to −920 mV. The electrolysis is performed in a zinc sulfate-sodium chloride electrolyte, because this type of electrolyte hardly dissolves the alloyed hot-dip galvanized layer chemically and is hardly affected by an oxide film formed on the surface of the alloyed hot-dip galvanized layer. When the type of the electrolyte is changed, the potential at which portions of the alloyed hot-dip galvanized layer which significantly affect the sliding property are selectively electrolyzed changes, and the change of the potential must be verified by a preliminary test.

Figure 1:
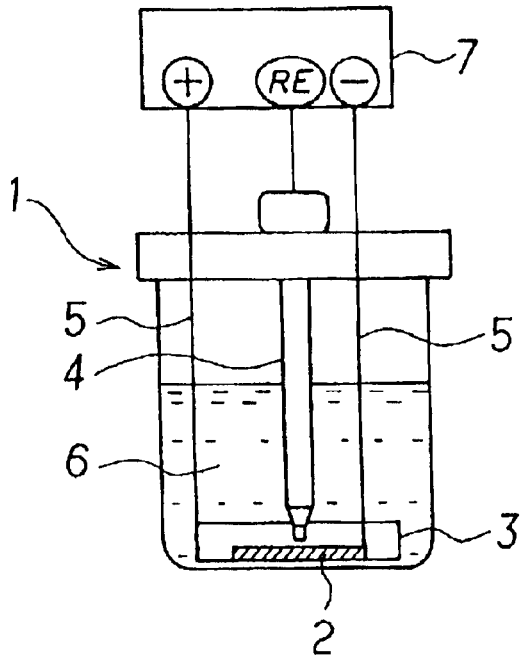
FIGS. 1 and 2 are a vertical sectional view and a perspective view, respectively, schematically illustrating an example of constant-potential electrolysis devices.
Figure 2:
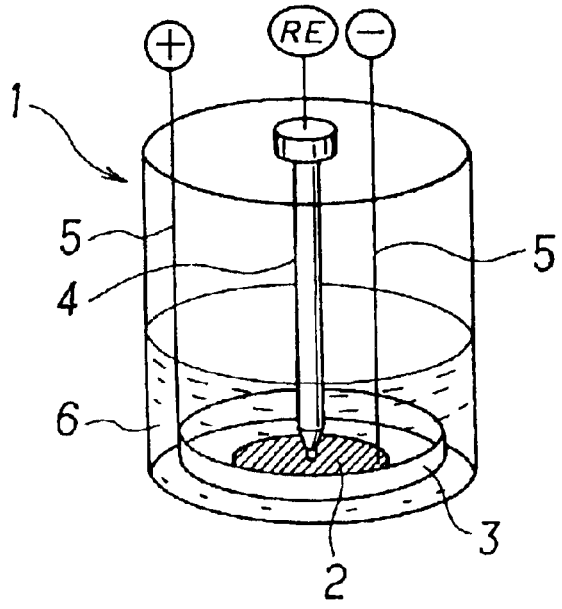

In general, the lower is the potential of the alloyed hot-dip galvanized steel sheet when it is immersed in the electrolyte, the lower is the quantity of electricity consumed during constant potential electrolysis. FIGS. 1 and 2 illustrate an example of a constant potential electrolytic apparatus 1. The electrolytic apparatus 1 uses an alloyed hot-dip galvanized steel sheet (a test sample) 2 as an anode and a platinum ring or platinum sheet, for example, as a counter electrode (a cathode) 3. Each of these components is connected to a device 7 for setting the potential via a platinum wire 5. The potential is preferably set using a potentiostat with a reference electrode (RE) 4 such as a saturated calomel electrode or a silver-silver chloride electrode.

As an electrolyte 6, an aqueous zinc sulfate-sodium chloride solution is used. This type of electrolytes hardly dissolves the alloyed hot-dip galvanized layer chemically and is hardly affected by an oxide film formed on the surface of the alloyed hot-dip galvanized layer. The concentrations of zinc sulfate and of sodium chloride are preferably controlled to within ranges from 1 to 50 mass % and 1 to 30 mass %, respectively. The alloyed hot-dip galvanized steel sheet of the present invention is not specified by its manufacturing process, but can be manufactured, for example, by controlling alloying conditions according to procedures disclosed in Japanese Unexamined Patent Application Publications No. 7-41925 and No. 10-130802 and by further exactly controlling plating and alloying conditions. Particularly, the alloying operation should preferably be performed at temperatures higher than those in ordinary cases, by controlling the Al content in the zinc-coated layer at a high level.

To form an alloyed hot-dip galvanized layer having characteristics of the alloyed hot-dip galvanized steel sheet of the present invention, the following conditions are preferred: quantity of plating on a single side: 40 to 60 g/m$^2$, Fe content in the zinc-coated layer: 9 to 13 mass %, Al content: 0.20 to 0.30 mass %, Pb content: 0.002 to 0.2 mass %, Mn content: 0.001 to 0.1 mass %, Si content: 0.0001 to 0.01 mass %, and P content: 0.0001 to 0.01 mass %. Mn, Si and P are not necessarily incorporated concurrently.

The steel is not specifically limited in its grade, but is preferably a ultra low carbon steel (e.g., C 0.0020-Si 0.01-Mn 0.10-P 0.01-Al 0.030-Ti 0.025-Nb 0.010 mass %). In particular, by satisfying either or both requirements of B content of 0.0002 to 0.015 mass % and Sb content of 0.002 to 0.015 mass %, a steel sheet having a significantly highly slidable galvanized layer can be manufactured.

EXAMPLES

A test piece of a ultra low carbon steel having the composition shown in Table 1 was processed into an ingot in a converter, was then continuously cast and thereby yielded a slab. The slab was subjected to hot-rolling process at a slab heating temperature of 1150° C. to 1250° C. and a finished temperature in hot-rolling process of 920° C., was rolled at 550° C. and thereby yielded a hot-rolled sheet coil 3.2 mm thick. The coil was subjected to acid pickling to remove mill scale, was subjected to cold rolling and thereby yielded a cold rolled steel sheet 0.8 mm thick.

TABLE 1

| C (mass %) | Si (mass %) | Mn (mass %) | P (mass %) | Al (mass %) | Ti (mass %) | Nb (mass %) | Sb (mass %) | B (mass %) |
|---|---|---|---|---|---|---|---|---|
| 0.0020 | 0.01 | 0.10 | 0.01 | 0.030 | 0.025 | 0.010 | 0.007 | 0.0005 |

The cold rolled steel sheet was subjected to a continuous hot-dip galvanized line at an annealing temperature of 790° C. to 830° C., a temperature of incoming sheet into the plating bath of 460° C. to 470° C., a bath temperature of the plating bath of 460° C. to 470° C., and an alloying temperature of 490° C. to 530° C. and thereby yielded an alloyed hot-dip galvanized steel sheet. The quantity of plating on a single side was set at 40 to 50 g/m$^2$, and the quantity of plating a single on both sides were controlled to be equal to each other.

The alloyed hot-dip galvanized steel sheet was stamped into a disc shape 15 mm in diameter and was subjected to constant potential electrolysis at a potential to a saturated calomel electrode of −930 mV using 20 mass % zinc sulfate−10 mass % sodium chloride aqueous solution as an electrolyte. The electrolysis was performed until a current density became 5 $\mu$A/cm$^2$ or below, and the quantity of electricity consumed from the beginning of electrolysis was determined. It took about 10 to 20 minutes for electrolysis. The end point of constant potential electrolysis was set at the time when an electrolysis current density decreased to 5 $\mu$A/cm$^2$. However, since the current is low in the vicinity of the end point, even if a current density level somewhat lower than the above specified current density would be employed, since there is not influence upon determination of quantity of electricity, and accordingly accurate estimation can be made.

Separately, using the steel sheet stamped into the disc shape as a test piece, the immersing potential of the test piece to a saturated calomel electrode in the aforementioned electrolyte was determined.

To estimate sliding property for comparison, a conventional rust preventive oil was applied to the alloyed hot-dip galvanized steel sheet in an amount of 1.5 g/m$^2$, the alloyed hot-dip galvanized steel sheet was then subjected to a drawing test using a cylindrical flat-bottom cup 33 mm in diameter to determine a limiting drawing ratio. The lower the rating of the limiting drawing ratio is, the higher the sliding property is. The limiting drawing ratio was rated as follows: the limiting drawing ratio of equal to or more than 2.0%: Rating 1, from 1.9% to 2.0%: Rating 2, from 1.8% to 1.9%: Rating 3, from 1.7% to 1.8%: Rating 4, and less than or equal to 1.7%: Rating 5. The results are shown in Table

2.

TABLE 2

| | Quantity of Plating on single side ($g/m^2$) | Content in plating layer Zn (mass %) | Content in plating layer Fe (mass %) | Potential upon immersing (mV vs SCE) | Quantity of electricity during constant potential electrolysis ($C/cm^2$) | Sliding property rating |
|---|---|---|---|---|---|---|
| Inventive Example 1 | 40 | 90.4 | 9.6 | −900 | 0.13 | 1 |
| Inventive Example 2 | 47 | 88.3 | 11.6 | −880 | 0.16 | 1 |
| Inventive Example 3 | 40 | 88.5 | 11.5 | −886 | 0.21 | 1 |
| Inventive Example 4 | 45 | 89.6 | 10.4 | −870 | 0.30 | 1 |
| Inventive Example 5 | 43 | 90.1 | 9.9 | −852 | 0.47 | 3 |
| Inventive Example 6 | 45 | 90.8 | 9.2 | −845 | 0.47 | 3 |
| Inventive Example 7 | 47 | 91.0 | 9.0 | −854 | 0.52 | 3 |
| Comp. Ex. | 42 | 90.0 | 10.0 | −825 | 0.55 | 5 |

The zinc-coated steel sheet according to Comparative Example in which the quantity of electricity exceeds 0.5 $C/cm^2$ exhibits deteriorated sliding property of "Rating 5". In contrast, the galvanized steel sheets in which the quantity of electricity is less than or equal to 0.5 $C/cm^2$ exhibit satisfactory sliding property of "Rating 3" or below. Particularly, all the galvanized steel sheets in which the quantity of electricity is less than or equal to 0.3 $C/cm^2$ exhibit significantly satisfactory sliding property of "Rating 1".

In addition, all the steel sheets exhibiting an immersing potential of less than or equal to −850 mV exhibit satisfactory sliding property of "Rating 3" or below.

Industrial Applicability

The present invention can provide an alloyed hot-dip galvanized steel sheet stably exhibiting excellent sliding property.

What is claimed is:

1. An alloyed hot-dip galvanized steel sheet with excellent processability and particularly with excellent sliding property, wherein, when the alloyed hot-dip galvanized steel sheet is electrolyzed according to a constant potential electrolysis process in a zinc sulfate-sodium chloride electrolyte at a potential to a saturated calomel electrode in a range of from −940 mV to −920 mV, the quantity of electricity passing therethrough is less than or equal to 0.5 $C/cm^2$.

2. An alloyed hot-dip galvanized steel sheet with excellent processability and particularly with excellent sliding property, exhibiting a potential to a saturated calomel electrode of less than or equal to −850 mV when the alloyed hot-dip galvanized steel sheet is immersed in a zinc sulfate-sodium chloride electrolyte.

* * * * *